US007448530B1

(12) United States Patent
Winikoff

(10) Patent No.: US 7,448,530 B1
(45) Date of Patent: Nov. 11, 2008

(54) LAUNDRY HAMPER

(76) Inventor: Robert Winikoff, 7915 Cote Ste. Luc Road, Apt. 608, Cote Ste. Luc, Quebec (CA) H4W 1R4

( * ) Notice: Subject to any disclaimer, the term of this patent is extended or adjusted under 35 U.S.C. 154(b) by 0 days.

(21) Appl. No.: 11/796,656

(22) Filed: Jun. 20, 2007

(51) Int. Cl.
*A47B 81/00* (2006.01)

(52) U.S. Cl. ..... 232/1 B; 232/44

(58) Field of Classification Search ..... 232/1 B, 232/1 E, 43.1, 43.3, 44; D32/37; 220/476, 220/345.1; 49/404
See application file for complete search history.

(56) References Cited

U.S. PATENT DOCUMENTS 1,800,825 A 4/1931 Feltault
1,800,826 A 4/1931 Feltault
2,036,794 A * 4/1936 Derman ..... 232/43.5
D195,279 S * 5/1963 Taylor ..... D32/37
4,037,756 A 7/1977 Jaquish
4,146,278 A 3/1979 Seitel
5,405,043 A 4/1995 Meloney
5,700,293 A * 12/1997 Rydell ..... 8/137
D398,107 S * 9/1998 Ratcliff ..... D32/37
6,062,416 A * 5/2000 Smillie ..... 220/524
7,014,096 B2 * 3/2006 Hinds ..... 232/1 B

* cited by examiner

*Primary Examiner*—William L. Miller

(57) ABSTRACT

A laundry hamper having a shallow box-like container with an open front and a door slidably mounted on the front of the container to close the open front. The door has a height less than the height of the front of the container. The door is movable on the container between a lowered position where the bottom of the door is adjacent the bottom of the container and the top of the door is spaced from the top of the container to provide a top inlet opening to the interior of the container, and a raised position where the top of the door is adjacent the top of the container and the bottom of the container is spaced from the bottom of the container to provide a bottom outlet opening from the interior of the container. The outlet opening is closed when the inlet opening is open, and the inlet opening is closed when the outlet opening is open.

30 Claims, 4 Drawing Sheets

LAUNDRY HAMPER

BACKGROUND OF THE INVENTION

1. Technical Field

The invention is directed toward a laundry hamper.

2. Background Art

Laundry hampers are most often containers loose on the floor and take up space. The containers are top loading and top emptying. Emptying is difficult and awkward. It is known to mount laundry hampers on the wall to get them out of the way and off the floor. Most such hampers are normally top loading and front emptying making unloading easier since the bottom of the hamper is well above the floor. However, the known hampers have a removable front to unload the hamper making operation of the hamper more difficult in having to remove and replace a front cover, and making the hamper more expensive to manufacture. The hamper is also more expensive to install since the hamper is normally built into a wall requiring modification of the wall. The location of the hamper in a room may also detract from the appearance of the room.

SUMMARY OF THE INVENTION

It is the purpose of the present invention to provide a laundry hamper which is simple and inexpensive in construction and easy to mount, even in an out-of the way place. It is another purpose of the present invention to provide a hamper which is easy to load and unload.

The laundry hamper of the present invention is designed to be mounted on any wall but most commonly on the portion of a wall behind an open door in a room, or on the back of the door itself. The hamper is of the top loading-bottom emptying type. The hamper has an open front that is partly closed by a sliding door. The sliding door has a height less than the height of the open front. When the door is in a normal down position, a top inlet opening is formed in the hamper above the top of the door so dirty clothes can be put into the hamper. When the door is lifted up, a bottom outlet opening is formed in the hamper to allow the collected dirty clothes to fall out of the hamper into a basket and then be washed. The hamper has pushing means within the hamper to push the dirty clothes down and out of the hamper to assist unloading if needed. The pushing means is operated from outside the hamper. The hamper can also be provided with movable support means for supporting a laundry bag in an open position under the bottom outlet opening of the hamper for collecting the laundry exiting from the opening again making it easer to unload the hamper.

The invention is particularly directed toward a laundry hamper having a shallow box-like container with an open front and a door slidably mounted on the front of the container to close the open front. The door has a height less than the height of the front of the container. The door is movable on the container between a lowered position where the bottom of the door is adjacent the bottom of the container and the top of the door is spaced from the top of the container to provide a top inlet opening to the interior of the container and a raised position where the top of the door is adjacent the top of the container and the bottom of the container is spaced from the bottom of the container to provide a bottom outlet opening from the interior of the container. The outlet opening is closed when the inlet opening is open, and the inlet opening is closed when the outlet opening is open.

DETAILED DESCRIPTION OF THE INVENTION

Figure 1:
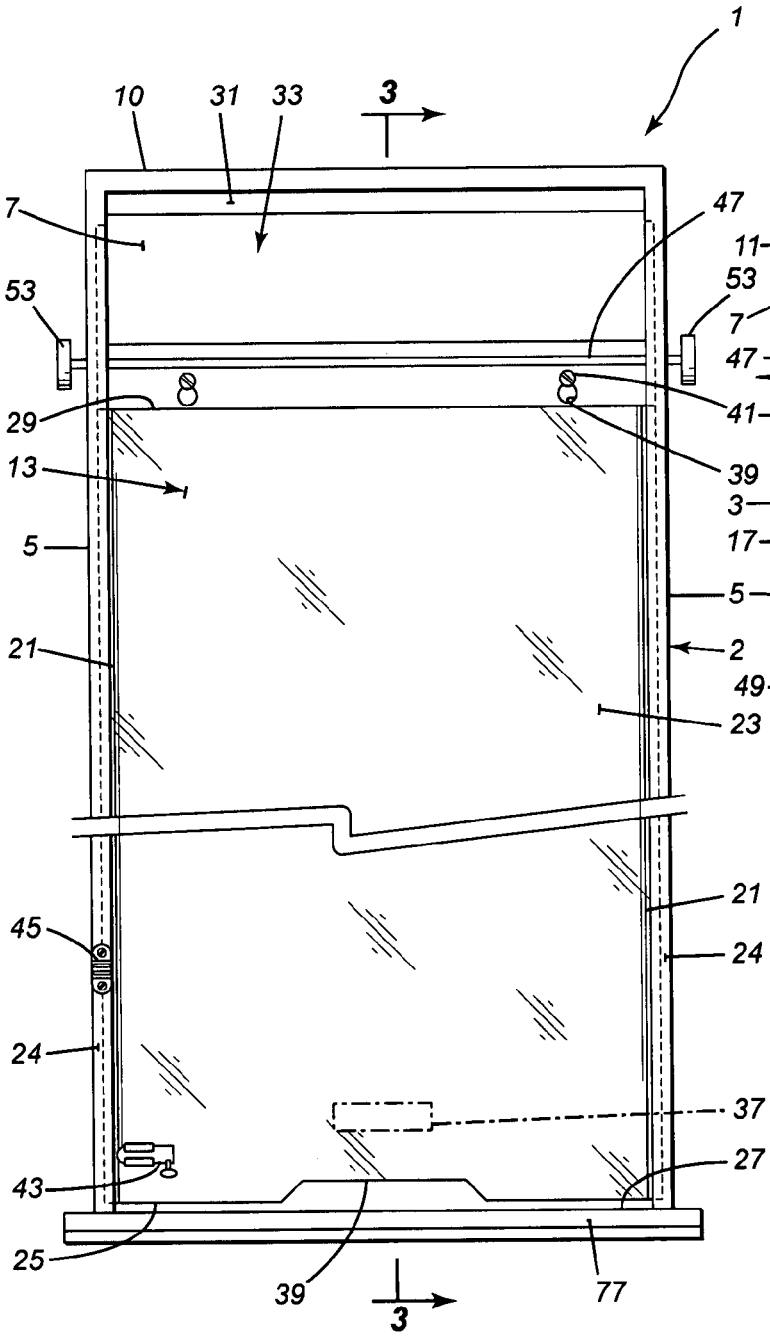
FIG. 1 is a front view of the hamper with the sliding door down.

The laundry hamper 1, as shown in FIGS. 1 to 4, has a narrow, box-like container 2. The container 2 has a back wall 3, sidewalls 5, a top wall 7 that slopes up from the back wall 3 to the front, and a bottom wall 9 that slopes down from the back wall 3 to the front. The front of the container 1 is open. The top and bottom walls 7, 9 slope at an angle usually ranging between twenty and forty five degrees. The hamper 1 can have a horizontal shelf 10 on top of the container 2, the shelf extending rearwardly from the front of the top wall 7 with a vertical support wall 11 supporting the rear end of the shelf, the support wall 11 being an extension of the back wall 3 of the container.

Figure 5:
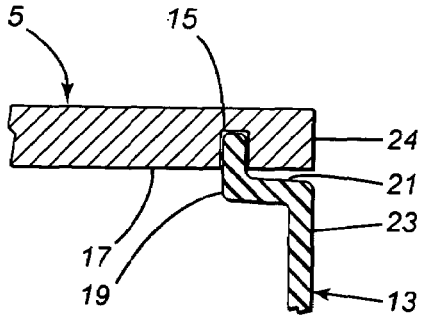
FIG. 5 is a detailed cross-section view, taken along line 5-5 in FIG. 3, of one flange of the sliding door mounted in a groove in the sidewall of the hamper.

A sliding door 13 closes most of the open front of the container 2. The door 13 has a height that is about eight or ten inches less than the height of the open front, the open front being about four feet high. The dimensions can vary. As shown in FIG. 5, a groove 15 is provided in the inner surface 17 of each sidewall 5 adjacent the front. The groove 15 is almost as long as the height of the sidewall 5. The door 13 has a flat main section 21 nearly as wide as the open front of the container 2. A short side section 23 extends rearwardly from each side of the main section 21. A narrow flange 19 extends laterally outwardly from the free edge of each side section 23, the flanges parallel to the main section 21 but offset rearwardly therefrom. The flanges 19 are insertable into the grooves 15 to mount the door 13 slidably on the sidewalls 5. The door 13 preferably has the flanges 19 parallel to, but located slightly rearwardly of, the main section 23 of the door to have the main section flush with the front 24 of the side walls 5 of the container. To have the main section 21 of the door flush with the front 24 of the sidewalls 5 increases the capacity of the hamper and also improves the appearance of the hamper. The door 13 is flexible so it can be bent slightly about its longitudinal axis to insert the flanges 19 into the grooves 15. The short side sections 23 have been shown as being straight and perpendicular to the main section 21, but they can also be curved over most of their width to merge smoothly with the main section 21. The side sections 23 help strengthen the door 13.

Figure 3:
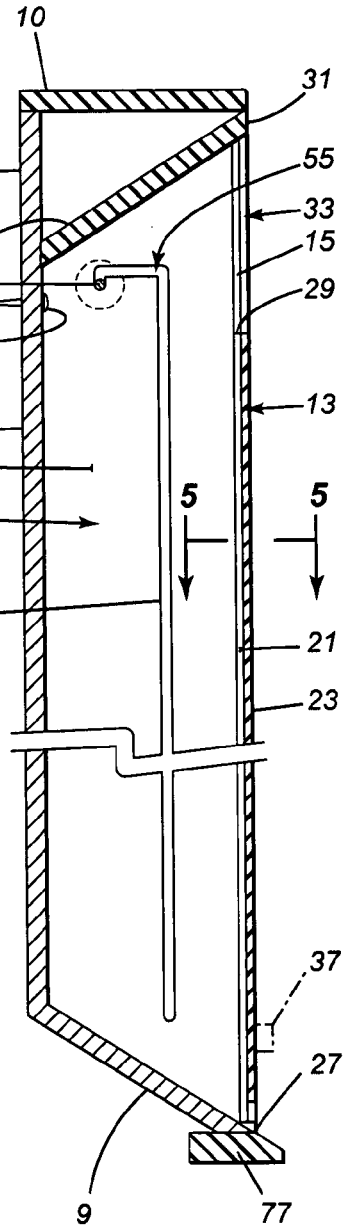
FIG. 3 is a cross-section view of the hamper taken along line 3-3 in FIG. 1.
Figure 2:
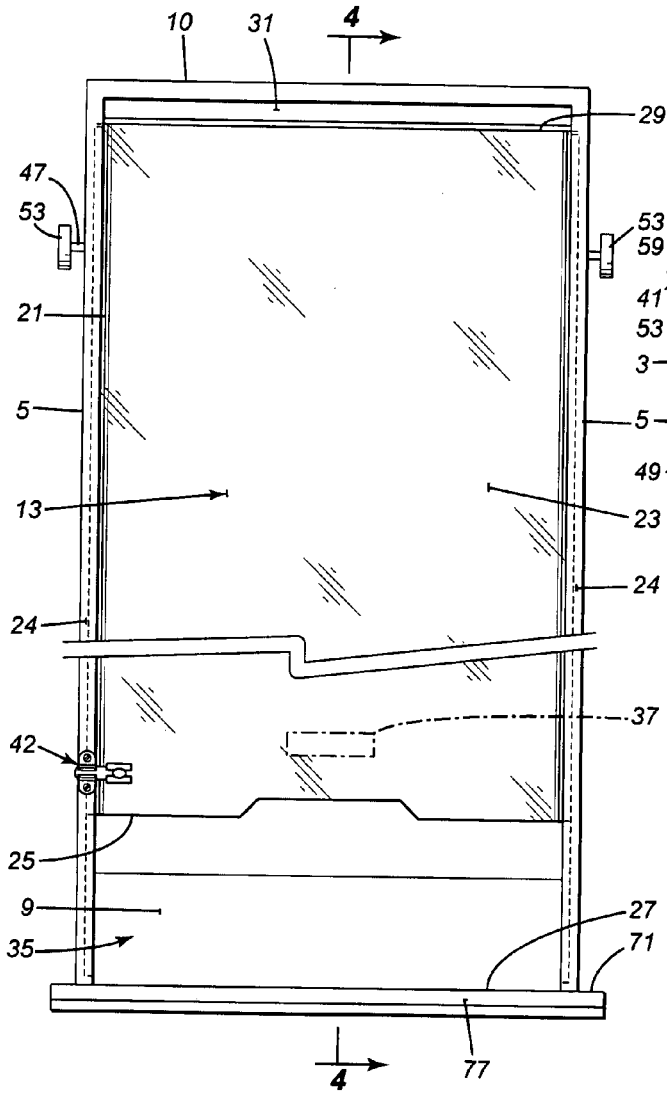
FIG. 2 is a front view of the hamper with the sliding door up.
Figure 4:
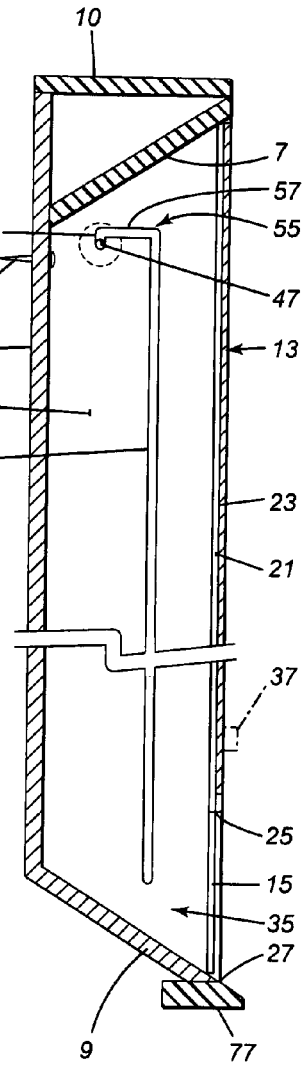
FIG. 4 is a cross-section view of the hamper taken along line 4-4 in FIG. 2.

With the door 13 in a normal lowered position, as shown in FIGS. 1 and 3, the bottom 25 of the door rests on the bottom wall 9 of the container 2 adjacent its front edge 27. In this position, the top 29 of the door 13 is about eight to ten inches below the front edge 31 of the top wall 7 of the container 2 providing a top inlet opening 33 to the interior of the hamper. The door 13 can be raised from its normal, lowered position to have the top 29 of the door abut or rest close to the front edge 31 of the top wall 7, closing the inlet opening 33 as shown in FIGS. 2 and 4. In this raised position, the bottom 25 of the door 13 is about eight to ten inches above the front edge 27 of the bottom wall 9 to provide a bottom outlet opening 35 from the interior of the container 2. The inlet and outlet openings are about the same size. Having the inlet and outlet openings 33, 35 about the same size, maximizes the holding capacity of the container. A handle 37, shown in dotted lines, can be provided on the front of the door 13 to be used in raising or lowering the door if desired.

The hamper 1 is normally mounted with fasteners, on a wall or a door, passing through the hamper's back wall 3. A pair of keyhole slots 39 can be provided in the back wall 3 adjacent the top of the back wall 3, the slots 39 receiving the heads 41 of fasteners inserted into a wall or a door. If needed a second pair of keyhole slots (not shown) can be provided in the back wall 3 adjacent the bottom of the back wall to be used with additional fasteners (not shown) on the wall or door to more securely hold the hamper on the wall or door. The hamper is mounted to have its inlet opening 33 slightly above the head of an adult with its outlet opening 35 then located a few feet off the floor. The hamper is normally filled with dirty laundry through the normally open top inlet 33. The angled top wall 7 facilitates entry of the clothes, directing them downwardly into the hamper. When the hamper is full, a laundry basket can be placed under the hamper, the door 13 can be lifted, and the clothes will drop out of the hamper into the laundry basket through the outlet opening 35. The angled bottom wall 9 facilitates exiting of the clothes, usually without any assistance.

If desired, the bottom 25 of the door 13, in its lowered position, can be spaced about three-quarters of an inch above the front edge 27 of the bottom wall 9. The three-quarters of an inch clearance space below the bottom of the door provides room for the user to grip the bottom of the door and raise it to unload the hamper. To space the door above the bottom wall 9, the grooves 15 can terminate a short distance above the bottom wall 9. Alternatively, a shallow cutout 39 can be formed in the door, extending upwardly from the bottom edge 25 of the door between its sides to provide the clearance space. Either arrangement could be used to replace handle 37.

Cooperating locking means 42 can be provided on the door 13 and one of the sidewalls 5 for holding the door in the raised position, if required. The locking means 42 includes a sliding lock bar 43 on the door 13. The bar 43 is located near the bottom 25 of the door 13 adjacent one side 21 and cooperates with keeper means 45 on the front 24 of an adjacent sidewall 5 to hold the door 13 in its raised position.

The hamper 1 has pushing means within the container for pushing laundry down in the hamper if needed. The pushing means comprises a push bar 47 extending horizontally across the container 2 between the sidewalls 5 of the container and extending through vertical slots 49 in the approximate center of the sidewalls 5. Retaining means can be provided on the push bar 47 to retain the bar within the slots 49. The retaining means can comprise knobs 53 on the ends of the bar 47 adjacent the outer surface of the sidewalls 5, the knobs larger than the width of the slots 49. The push bar 47 can be moved down the slots 49 by gripping the knobs 53 on both sides of the container to push laundry out of the container, while the door 13 is raised and locked in its raised position, by the lock bar 43.

Holding means 55 are provided within the container at the top for holding the push bar 47 out of the way when it is not being used. The holding means 55 can comprise a horizontal slot extension 57 extending rearwardly from the top of the slots 49, the horizontal extension 57 terminating in a short downward extension 59 located adjacent the top of the back wall 3. When not in use, the push bar 47 rests in the bottom of the downward extension 59 out of the way of laundry being loaded into the hamper through the inlet opening. The push bar 47 can be lifted out of the extensions 57, 59 and moved down the slots 49 to push the laundry within the hamper downwardly out of the hamper when unloading.

Figure 6:
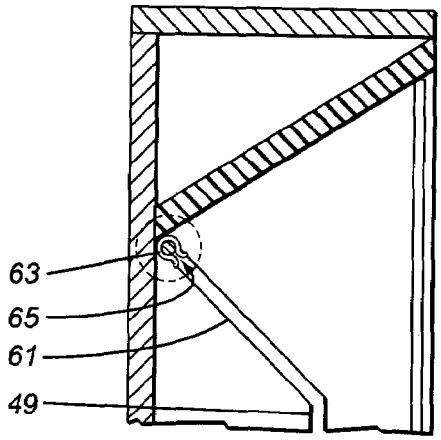
FIG. 6 is a detail view of another holding means for the push bar.

While one form of holding means 55 for the push bar 47 has been described, other types of holding means can be used. For example, the slots 49 for the push bar could have an angled section 61 near the top extending toward the top of the back wall 3 as shown in FIG. 6. Spring clips 63 could be mounted to the bottom of the top wall 7 or the top of the back wall 3 with screws (not shown), opening downwardly with their mouth 65 aligned with the top portion of the slot section 61. The push bar 47 can be moved up the angled slot section 61 and into the spring clips 63 to be retained within the clips out of the way when not needed.

The sidewalls 5 can widen, from back to front, toward the bottom from the top, while remaining parallel, so that the hamper has a larger, horizontal, cross-sectional area at the bottom than at the top, to make it easer for the clothes to fall to the bottom of the hamper.

Figure 7:
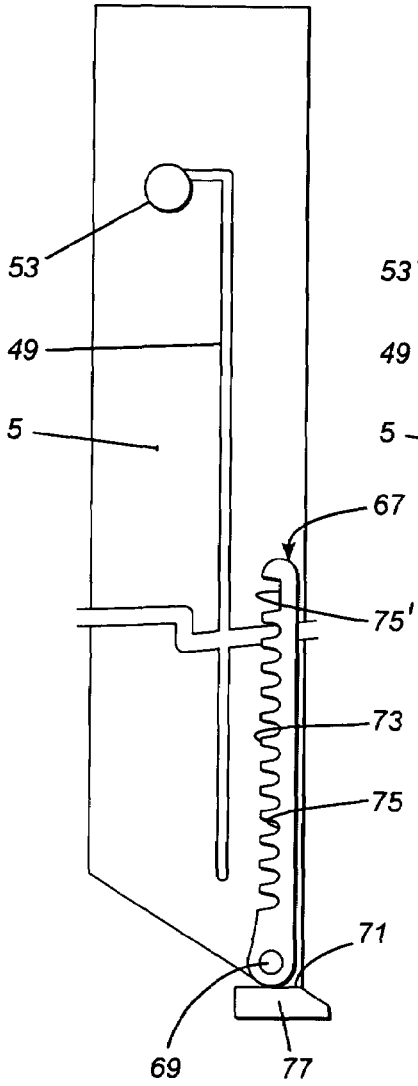
FIG. 7 is a side view of a modified hamper with laundry bag support arms in an upright storage position.
Figure 8:
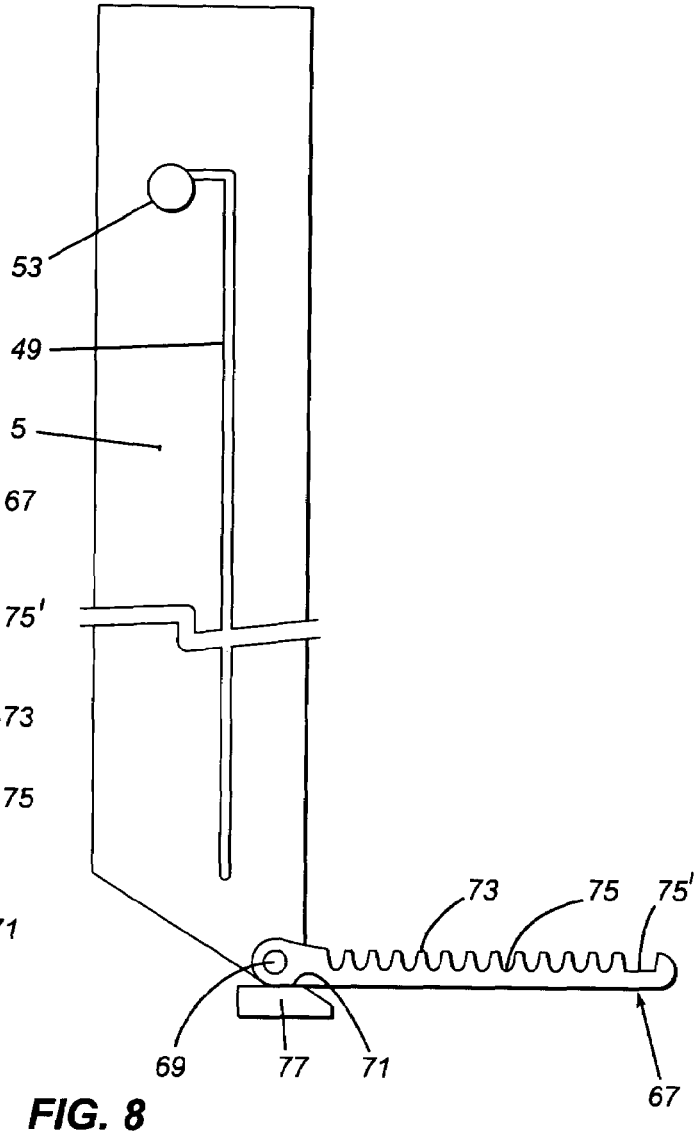
FIG. 8 is a side view of the hamper shown in FIG. 7 with the support arms in a horizontal support position.

The hamper 1 is preferably provided with support arms 67, one on each side of the hamper adjacent the bottom of the hamper as shown in FIGS. 7 and 8. The support arms 67 are each pivotably mounted by a pivot 69 at one end of the arm to the bottom portion of a sidewall 5. The support arms 67 lie adjacent the outer surface of the sidewalls 5, normally extending upright in a storage position. The support arms 67 can be pivoted forwardly to a horizontal, support position, resting on stops 71 on the sidewalls 5. A laundry bag can be mounted via its handles on the arms 67 when they are in the support position, the mouth of the bag adjacent and just under the outlet opening of the hamper to receive the laundry being unloaded from the hamper. The top surface 73 of the arms 67 can be serrated to provide slots 75 for the laundry bag handles to help keep the mouth of the bag open. The pivots 69 can be friction pivots so as to retain the arms in an upright storage position. If desired, the support arms 67 can be angled slightly rearwardly when in the upright, storage position, resting against a second set of stops (not shown) on the sidewalls. Friction pivots are then not required to maintain the arms 67 in the upright storage position.

The support arms 67 are useful when a home has a plurality of the hampers. The front slot 75' can be widened to hold a plurality of laundry bags during unloading of the hamper. When the hampers are to be unloaded on laundry day, the unloader can hang both the unfilled laundry bags and those laundry bags already filled on the front slots 75' of the hamper to be unloaded. This allows the unloader to use both hands to position the laundry bag to be filled in the slots 75 on the arms 67 of the hamper being presently unloaded and to operate the push bar 47 if needed. The bags on the slots 75' are out of the way of the bag being loaded, off the floor and at waist height for easy handling when moving on to the next the hamper. Only one trip is required to the laundry area. Thus all the hampers can be unloaded with a minimum of effort and time.

The hamper 1 can be provided with a front bumper 77 extending forwardly from the front of the bottom wall. The front bumper 77 would protect the hamper if mounted on a wall beside a door that opens against the hamper. The front bumper 77 can extend around the front bottom of the side walls to provide the stops 71 for the support arms 67.

Figure 9:
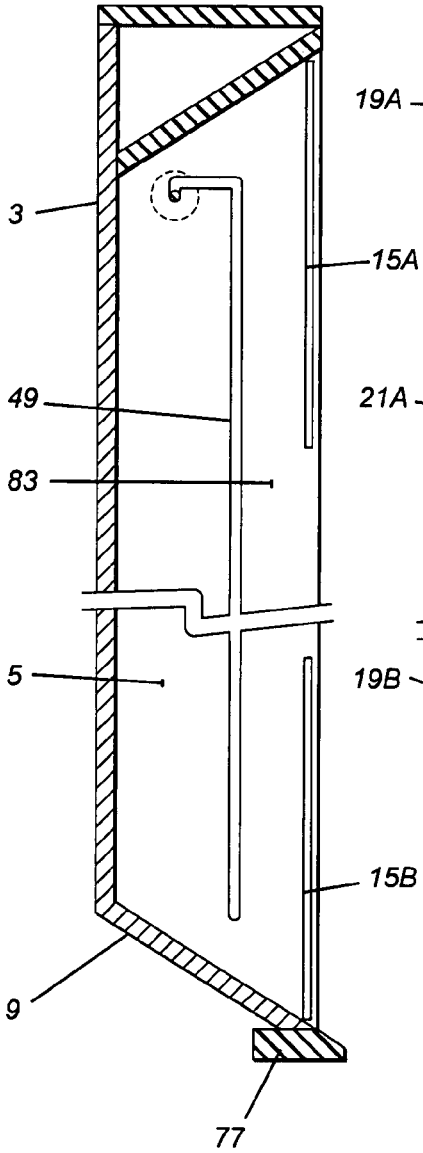
FIG. 9 is cross-section view of a modified container with the door removed and showing slightly different door receiving grooves.
Figure 10:
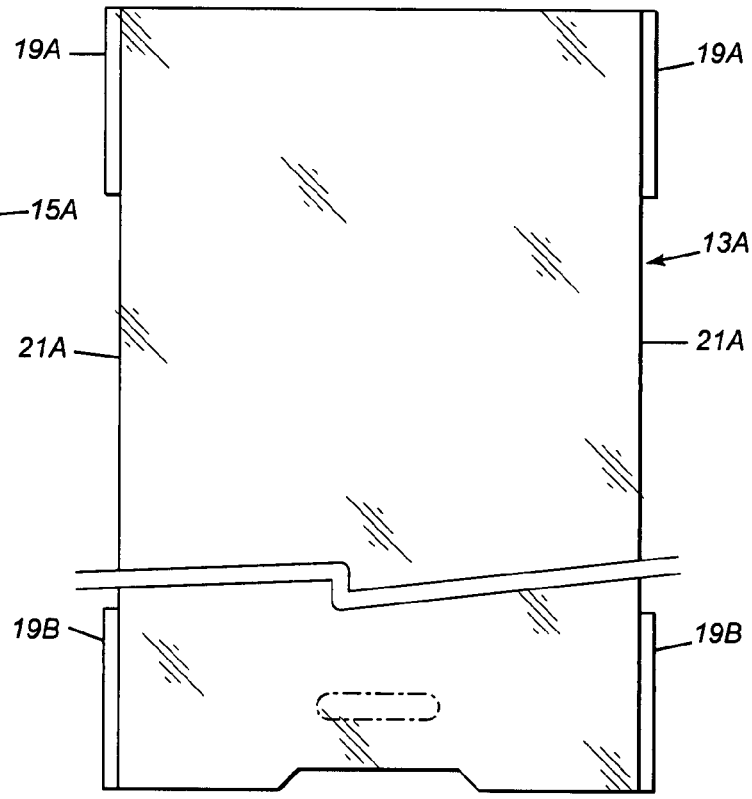
FIG. 10 is an elevation view of the door used with the container of FIG. 9.

To strengthen the hamper, the grooves 15 in the sidewalls and the flanges on the door could be interrupted in the central portion of the container so as not to weaken the sidewalls. As shown in FIGS. 9 and 10 the grooves in the sidewalls 5A would each have a top section 15A and a bottom section 15B. Each section would be between about sixteen to twenty inches long. The door 13A would have top and bottom flange sections 19A and 19B on its sides 21A to fit in the top and bottom groove sections 15A, 15B respectively. The flange sections 19A, 19B would be between eight and ten inches long. The bottom of the flange sections 19A, 19B would rest on the bottom of the groove sections 15A, 15B with the door 13A closing the front of the container. In the raised position of the door, the groove sections 15A, 15B would be long enough to allow the top of the door to abut the top of the container to close the top opening and to provide a maximum bottom opening. In this position, the top of the flange sections would be close or adjacent to the top of the groove sections. The center portion 83 (not shown to scale) of the sidewalls 5A between the groove sections 15A, 15B would be over two feet in height and would strengthen the container since there is no groove in this portion of the side walls to weaken it.

I claim:

1. A laundry hamper for storing laundry items, comprising: a shallow box-shaped container for mounting on a door or wall, the container having a top, a bottom, and an open front, a door slidably mounted on the front of the container to close the open front, the door having a top and a bottom and a height less than the height of the front of the container, the door movable on the container between a lowered position where the bottom of the door is adjacent the bottom of the container and the top of the door is spaced from the top of the container to provide a top inlet opening to the interior of the container for depositing the laundry items and a raised position where the top of the door is adjacent the top of the container and the bottom of the door is spaced from the bottom of the container to provide a bottom outlet opening from the interior of the container for removing the laundry items, the outlet opening being closed when the inlet opening is open, and the inlet opening being closed when the outlet opening is open.

2. A laundry hamper as claimed in claim 1 wherein the container has sidewalls; a vertical groove in the inner surface of each sidewall adjacent the front of the container, the door having a main body substantially covering the open front of the container and having narrow flanges extending laterally from the sides of the main body of the door, the flanges slidably mounted in the grooves, the flanges parallel to, but slightly rearwardly of, the main body of the door.

3. A laundry hamper as claimed in claim 2 wherein the container has a back wall, a top wall forming the top of the container and extending forwardly and slightly upwardly from the top of the back wall, and a bottom wall forming the bottom of the container and extending forwardly and slightly downwardly from the bottom of the back wall.

4. A laundry hamper as claimed in claim 3 wherein the container has one support arm pivotably mounted at one end by pivot means to the bottom of each sidewall, each support arm movable about the pivot means between an upright storage position adjacent the sidewall and a horizontal support position in front of the outlet opening to support a laundry bag adjacent and under the opening.

5. A laundry hamper as claimed in claim 2 wherein the hamper has one support arm pivotably mounted at one end by pivot means the bottom of each sidewall, each support arm movable about the pivot means between an upright storage position adjacent the sidewall and a horizontal support position in front of the outlet opening to support a laundry bag adjacent and under the opening.

6. A laundry hamper as claimed in claim 2 including cooperating locking means on the door and one of the sidewalls to lock the door in the raised position.

7. A laundry hamper as claimed in claim 6 wherein the side walls of the container each have a vertical slot in their central area and a push bar slidably mounted in the slots, the push bar extending across the interior of the container, through the slots, and past the sidewalls so it can be gripped on both ends outside the container and moved in the slots.

8. A laundry hamper as claimed in claim 7 wherein the container has a back wall, a top wall forming the top of the container and extending forwardly and slightly upwardly from the top of the back wall, and a bottom wall forming the bottom of the container and extending forwardly and slightly downwardly from the bottom of the back wall.

9. A laundry hamper as claimed in claim 8 wherein the container has one support arm pivotably mounted at one end by pivot means to the bottom of each sidewall, each support arm movable about the pivot means between an upright storage position adjacent the sidewall and a horizontal support position in front of the outlet opening to support a laundry bag adjacent and under the opening.

10. A laundry hamper as claimed in claim 7 wherein the hamper has one support arm pivotably mounted at one end by pivot means to the bottom of each sidewall, each support arm movable about the pivot means between an upright storage position adjacent the sidewall and a horizontal support position in front of the outlet opening to support a laundry bag adjacent and under the opening.

11. A laundry hamper as claimed in claim 7 including holding means at the top of the container for holding the push bar out of the way when not needed.

12. A laundry hamper as claimed in claim 11 wherein the holding means comprise an extension of the slots in the sidewalls, the extension in each slot extending rearwardly from the top of the slot to be adjacent the top rear of the container and then downwardly a short distance.

13. A laundry hamper as claimed in claim 11 wherein the container has a back wall, a top wall forming the top of the container and extending forwardly and slightly upwardly from the top of the back wall, and a bottom wall forming the bottom of the container and extending forwardly and slightly downwardly from the bottom of the back wall.

14. A laundry hamper as claimed in claim 13 wherein the container has one support arm pivotably mounted at one end by pivot means to the bottom of each sidewall, each support arm movable about the pivot means between an upright storage position adjacent the sidewall and a horizontal support position in front of the outlet opening to support a laundry bag adjacent and under the opening.

15. A laundry hamper as claimed in claim 11 wherein the hamper has one support arm pivotably mounted at one end by pivot means to the bottom of each sidewall, each support arm movable about the pivot means between an upright storage position adjacent the sidewall and a horizontal support position in front of the outlet opening to support a laundry bag adjacent and under the opening.

16. A laundry hamper as claimed in claim 1 wherein the container has sidewalls, the door slidably mounted on the front of the sidewalls, and cooperating locking means on the door and a side wall to lock the door in the raised position.

17. A laundry hamper as claimed in claim 16 wherein the sidewalls of the container each have a vertical slot in their central area and a push bar slidably mounted in the slots, the push bar extending across the interior of the container, through the slots, and past the sidewalls so it can be gripped on both ends outside the container and moved in the slots.

18. A laundry hamper as claimed in claim 17 including holding means at the top of the container for holding the push bar out of the way when not needed.

19. A laundry hamper as claimed in claim 18 wherein the holding means comprise an extension of the slots in the sidewalls, the extension in each slot extending rearwardly from the top of the slot to be adjacent the top rear of the container and then downwardly a short distance.

20. A laundry hamper as claimed in claim 18 wherein the container has a back wall, a top wall forming the top of the container and extending forwardly and slightly upwardly from the top of the back wall, and a bottom wall forming the bottom of the container and extending forwardly and slightly downwardly from the bottom of the back wall.

21. A laundry hamper as claimed in claim 20 wherein the container has one support arm pivotably mounted at one end by pivot means to the bottom of each sidewall, each support arm movable about the pivot means between an upright storage position adjacent the sidewall and a horizontal support position in front of the outlet opening to support a laundry bag adjacent and under the opening.

22. A laundry hamper as claimed in claim 18 wherein the hamper has one support arm pivotably mounted at one end by pivot means to the bottom of each side wall, each support arm movable about the pivot means between an upright storage position adjacent the side wall and a horizontal support position in front of the outlet opening to support a laundry bag adjacent and under the opening.

23. A laundry hamper as claimed in claim 17 wherein the container has a back wall, a top wall forming the top of the container and extending forwardly and slightly upwardly from the top of the back wall, and a bottom wall forming the bottom of the container and extending forwardly and slightly downwardly from the bottom of the back wall.

24. A laundry hamper as claimed in claim 23 wherein the container has one support arm pivotably mounted at one end by pivot means to the bottom of each sidewall, each support arm movable about the pivot means between an upright storage position adjacent the sidewall and a horizontal support position in front of the outlet opening to support a laundry bag adjacent and under the opening.

25. A laundry hamper as claimed in claim 17 wherein the hamper has one support arm pivotably mounted at one end by pivot means to the bottom of each sidewall, each support arm movable about the pivot means between an upright storage position adjacent the sidewall and a horizontal support position in front of the outlet opening to support a laundry bag adjacent and under the opening.

26. A laundry hamper as claimed in claim 1 wherein the container has a back wall, a top wall forming the top of the container and extending forwardly and slightly upwardly from the top of the back wall, and a bottom wall forming the bottom of the container and extending forwardly and slightly downwardly from the bottom of the back wall.

27. A laundry hamper as claimed in claim 26 wherein the container has sidewalls, one support arm pivotably mounted at one end by pivot means to the bottom of each sidewall, each support arm movable about the pivot means between an upright storage position adjacent the sidewall and a horizontal support position in front of the outlet opening to support a laundry bag adjacent and under the opening.

28. A laundry hamper as claimed in claim 1 wherein the container has sidewalls, one support arm pivotably mounted at one end by pivot means to the bottom of each sidewall, each support arm movable about the pivot means between an upright storage position adjacent the sidewall and a horizontal support position in front of the outlet opening to support a laundry bag adjacent and under the opening.

29. A laundry hamper as claimed in claim 1 wherein the container has sidewalls, the sidewalls widening slightly from front to back from their top toward the bottom so the container's horizontal cross-sectional area enlarges toward the bottom from the top.

30. A laundry hamper as claimed in claim 1 wherein the container has sidewalls; a vertical bottom groove section and a vertical top groove section in the inner surface of each sidewall adjacent the front of the container, the top and bottom groove sections each as long as twice the distance the door can move and separated by a distance greater than the length of the groove sections; the door having a main body substantially covering the open front of the container and having narrow top and bottom flange sections extending laterally from the sides of the main body of the door, the flange sections slidably mounted in the groove sections, the flange sections parallel to, but slightly rearwardly of, the main body of the door and having a length about half the length of the groove sections.

* * * * *